US007879129B2

(12) United States Patent
Kösters et al.

(10) Patent No.: US 7,879,129 B2
(45) Date of Patent: Feb. 1, 2011

(54) WEAR PART FORMED OF A DIAMOND-CONTAINING COMPOSITE MATERIAL, AND PRODUCTION METHOD

(75) Inventors: Rolf Kösters, Reutte (AT); Arndt Lüdtke, San Diego, CA (US)

(73) Assignee: Ceratizit Austria Gesellschaft mbH, Reutte/Tirol (AT)

( * ) Notice: Subject to any disclaimer, the term of this patent is extended or adjusted under 35 U.S.C. 154(b) by 535 days.

(21) Appl. No.: 11/607,602

(22) Filed: Dec. 1, 2006

(65) Prior Publication Data

US 2007/0092727 A1 Apr. 26, 2007

Related U.S. Application Data

(63) Continuation of application No. PCT/AT2005/000184, filed on May 30, 2005.

(30) Foreign Application Priority Data

Jun. 1, 2004 (AT) ..... GM386/2004

(51) Int. Cl.
*B22F 3/12* (2006.01)
*E21B 10/46* (2006.01)
*E21B 10/60* (2006.01)

(52) U.S. Cl. ..... 75/242; 51/307; 51/309; 175/420.2; 175/426; 419/27; 419/47; 419/48; 264/122

(58) Field of Classification Search ..... 75/242; 51/309; 175/420.2, 426; 419/27, 47, 48; 264/109, 122
See application file for complete search history.

(56) References Cited

U.S. PATENT DOCUMENTS

| | | | | |
|---|---|---|---|---|
| 3,496,682 | A * | 2/1970 | Quaas et al. | 75/252 |
| 3,778,261 | A * | 12/1973 | Nicholas et al. | 419/11 |
| 4,024,675 | A * | 5/1977 | Naidich et al. | 51/296 |
| 4,124,401 | A | 11/1978 | Lee et al. | |
| 4,378,975 | A * | 4/1983 | Tomlinson et al. | 51/309 |
| 4,664,705 | A * | 5/1987 | Horton et al. | 75/243 |
| 4,902,652 | A | 2/1990 | Kume et al. | |
| 5,008,737 | A | 4/1991 | Burnham et al. | |
| 5,045,972 | A | 9/1991 | Supan et al. | |
| 5,096,465 | A * | 3/1992 | Chen et al. | 51/295 |
| 5,186,724 | A * | 2/1993 | Sartor | 51/293 |
| 5,723,177 | A | 3/1998 | Brandrup-Wognsen et al. | |
| 5,783,316 | A | 7/1998 | Colella et al. | |
| 6,171,691 | B1 | 1/2001 | Nishibayashi | |
| 6,447,852 | B1 | 9/2002 | Gordeev et al. | |
| 6,482,248 | B1 * | 11/2002 | Holloway | 75/249 |
| 6,709,747 | B1 | 3/2004 | Gordeev et al. | |
| 2005/0230155 | A1 * | 10/2005 | Sung | 175/375 |

FOREIGN PATENT DOCUMENTS

| | | |
|---|---|---|
| EP | 0 116 403 A1 | 8/1984 |
| EP | 1 028 171 A1 | 8/2000 |
| JP | 2003-95743 | 4/2003 |
| WO | WO 99/12866 | 3/1999 |
| WO | WO 00/18702 | 4/2000 |
| WO | WO 2004/089850 A2 | 10/2004 |

OTHER PUBLICATIONS

Johnson, et al., "Diamond/A1 Metal Matrix Composites Formed by the Pressureless Metal Infiltration Process", dated Dec. 29, 1992.
Chinese Office Action dated Aug. 28, 2009.

* cited by examiner

*Primary Examiner*—Roy King
*Assistant Examiner*—Ngoclan T Mai
(74) *Attorney, Agent, or Firm*—Laurence A. Greenberg; Werner H. Stemer; Ralph E. Locher

(57) ABSTRACT

A wear part is formed of a diamond-containing composite material with 40 to 90% by volume of diamond grains, 0.001 to 12% by volume of carbidic phase, formed from one or more elements from the group Si, Ti, Zr, Hf, V, Nb, Ta, Cr, Mo, W, B, Sc, Y and lanthanides and 7 to 49% by volume of a metallic or intermetallic alloy with a liquidus temperature<1400° C., the metallic or intermetallic alloy containing the carbide-forming element or elements in dissolved or precipitated form and having a hardness at room temperature>250 HV.

24 Claims, No Drawings

WEAR PART FORMED OF A DIAMOND-CONTAINING COMPOSITE MATERIAL, AND PRODUCTION METHOD

CROSS-REFERENCE TO RELATED APPLICATIONS

This is a continuation, under 35 U.S.C. §120, of copending international application PCT/AT2005/000184, filed May 30, 2005, which designated the United States; this application also claims the priority, under 35 U.S.C. §119, of Austrian application GM 386/2004, filed Jun. 1, 2004; the prior applications are herewith incorporated by reference in their entirety.

BACKGROUND OF THE INVENTION

1. Field of the Invention

The invention relates to a wear part of a diamond-containing composite material and to a method for the production of such a wear part.

The term "wear part," also referred to as a wearing part, is understood to mean a component that is subjected to a high degree of wearing stress. Depending on the stress, a broad diversity of materials are used, such as hardened steels, high-speed tool steels, stellites, hard metals and hard materials. In view of the growing requirements for wear resistance, there is increasing interest in diamond-containing composite materials or material composites.

U.S. Pat. No. 4,124,401 describes a poly-crystalline diamond material, wherein the individual diamond grains are held together by silicon carbide and a metal carbide or metal silicide. Materials according to the patent, although very hard, can be machined into shape only in a highly complicated way.

European patent publication EP 0 116403 discloses a diamond-containing composite material which consists of 80 to 90% by volume of diamond and 10 to 20% by volume of an Ni- and Si-containing phase. The Ni component is present as Ni or Ni silicide, and the Si component is present as Si, SiC or Ni silicide. No further phase constituents are present between the diamond grains. In order to achieve a sufficient bond between the individual diamond grains, sintering temperatures>1400° C. are required. Since diamond is no longer stable at these temperatures under normal pressure conditions, according to the pressure/temperature graph correspondingly high pressures are required in order to avoid a decomposition of the diamond. The plants necessary for this purpose are costly. Moreover, the diamond composite material produced in this way has very low fracture toughness and poor machinability.

A method for producing a diamond/silicon-carbide composite material is described in international PCT publication WO 99/12866. Production takes place by the infiltration of a diamond skeleton with silicon or with a silicon alloy. On account of the high melting point of silicon and the high infiltration temperature due to this, diamond is converted to a high degree into graphite or, further on, into silicon carbide. Owing to the high brittleness, the mechanical machinability of this material presents very serious problems and is complicated.

U.S. Pat. No. 4,902,652 describes a method for producing a sintered diamond material. There, an element from the group of transition metals of the groups 4a, 5a and 6a of the periodic table, boron and silicon is deposited onto diamond powder by way of physical coating methods. Subsequently, the coated diamond grains are bonded to one another by way of a solid-phase sintering process. The resulting product thus obtained, disadvantageously, has high porosity, low fracture toughness, and poor machinability.

U.S. Pat. No. 5,045,972 describes a composite material, wherein, in addition to diamond grains with a size of 1 to 50 μm, there is a metal matrix which consists of aluminium, magnesium, copper, silver or their alloys. The disadvantage there is that the metal matrix is bound only deficiently to the diamond grains, so that the mechanical integrity is not afforded to a sufficient extent as a result. Also, the use of finer diamond powder, for example with a grain size<3 μm, as may be gathered from U.S. Pat. No. 5,008,737, does not improve the diamond/metal bond.

U.S. Pat. No. 5,783,316 describes a method wherein diamond grains are coated with W, Zr, Re, Cr or Ti, the coated grains are then compacted, and the porous body is infiltrated. The infiltration is effected, for example, with Cu, Ag or Cu/Ag melts. The high coating costs and insufficient wear resistance limit the field of use of composite materials produced in this way.

SUMMARY OF THE INVENTION

It is accordingly an object of the invention to provide a wear part formed of a diamond-containing composite material and a corresponding production method, which overcome the above-mentioned disadvantages of the heretofore-known devices and methods of this general type and which provide for a wear part with high wear resistance and that can be produced comparatively cost-effectively due to sufficient shaping machinability.

With the foregoing and other objects in view there is provided, in accordance with the invention, a wear part, comprising:

- a diamond-containing composite material with:
  - 40 to 90% by volume diamond grains;
  - 0.001 to 12% by volume carbidic phase formed from one or more elements selected from the group consisting of Si, Ti, Zr, Hf, V, Nb, Ta, Cr, Mo, W, B, Sc, Y, and lanthanides; and
  - 7 to 49% by volume of a metallic or intermetallic alloy with a liquidus temperature<1400° C.;
- the metallic or intermetallic alloy containing the carbide-forming element or elements in dissolved or precipitated form and having a hardness at room temperature>250 HV.

Due to the diamond fraction, the carbidic phase and the hard metallic or inter-metallic alloy, the wear part according to the invention has excellent wear resistance. The term "metallic alloy" is to be understood as meaning a single-phase or multiphase material which, in addition to metallic structural constituents, may also contain intermetallic, semi-metallic or ceramic structural constituents. The term "intermetallic alloy" is understood to mean a material which consists predominantly of intermetallic phase.

Both the fracture toughness of the diamond-containing composite material and the resulting technological properties, such as, for example, mechanical machinability, are afforded to a sufficient extent on account of the ductile, metallic or intermetallic phase constituents. The high bonding strength between the diamond grains and the metallic/intermetallic alloy has the effect of increasing the fracture toughness because of the carbidic phase which is formed between them. Suitable carbide-forming elements are the transition elements of the IIIb, IVb, Vb and VIb groups of the periodic system, lanthanides, B and Si. If the radioactive and highly costly elements are ignored, these are Si, Ti, Zr, Hf, V, Nb, Ta, Cr, Mo, W, B, Sc, Y and lanthanides. Composite carbides, consisting of two or more of the abovementioned elements, also lead to a good bonding between the diamond grains and the metallic/intermetallic alloy. The carbidic phase, in this case, preferably arises from a reaction of the carbide-forming element with diamond. In order to achieve good bonding, even a thickness of this carbidic phase in the nanometre range or a degree of covering of >60 per cent is sufficient. The term "degree of covering" is in this context to be understood as meaning that fraction of the diamond-grain surface which is encased by the carbidic phase. According to these premises, this corresponds to a volume content of the carbidic phase of >0.001%. If an upper limit of 12% by volume is overshot, the fracture toughness falls below a critical value and cost-effective machining is no longer afforded.

The carbide-forming element or elements are also present in dissolved or separated form in the metallic/intermetallic alloy and give rise, alone or together with further alloying elements, to a consolidation of the metallic/intermetallic alloy. In order to achieve a sufficient wear resistance of the diamond-containing composite material, a minimum hardness of the metallic/intermetallic alloy at room temperature of >250 HV, preferably >400 HV, must be set. The choice of the carbide-forming element depends on the matrix metal of the metallic/intermetallic alloy, on the production process and on the geometry of the wear part. Strong carbide formers, such as, for example, Ti, Zr, Hf, Cr, Mo, V and W, form thick carbide layers near the surface during the infiltration process, with the result that a depletion of the carbide-forming element occurs locally or the infiltration process is impeded. These elements are therefore suitable preferably for the production of smaller wear parts. Larger wear parts can advantageously be produced using Si, B, Y and La as carbide-forming elements. These elements are comparatively weak carbide formers. The carbide layers formed are therefore comparatively thin. Tests with Si have shown that even Si/C enrichments on the diamond-grain surface within the range of a few atomic layers are sufficient for an adequate bonding of the metallic alloy to the diamond grains.

Suitable matrix metals for the metallic alloy are Al, Fe, Co, Ni, Cu, Zn, Ag, Pb and Sn, the first six elements mentioned being particularly suitable. The carbide-forming elements and optionally further alloying elements are dissolved in the metallic alloy or are incorporated into this, for example, in the form of precipitations or intermetallic phase constituents. The alloy composition is in this case to be selected such that the liquidus temperature is <1400° C. and the solidus temperature is preferably <1200° C. This makes it possible to have a correspondingly low processing temperature, for example infiltration or hot-pressing temperature. It is consequently possible, according to the pressure/temperature phase graph for graphite/diamond, to carry out processing under comparatively low gas pressures of <1 kbar, preferably <50 bar. In comparison with conventional polycrystalline diamond (PCD), this signifies markedly reduced production costs.

In order to set a room temperature hardness of >250 HV, preferably >400 HV, the customary strength-increasing mechanisms, in particular solid-solution and precipitation hardening, may be adopted. What may be mentioned as being particularly suitable in this context are the precipitation-hardened Al alloys, such as, for example, Al—Mg—Si—Cu, Al—Cu—Ti, Al—Si—Cu and Al—Si—Mg, hypereutectic Al—Si alloys, heat-treatable Cu alloys and here again preferably alloys with an addition of Si and, further, Cr and/or Zr, hypereutectic Ag—Si alloys and Fe, Co and Ni alloys, the liquidus or the solidus temperature of which is lowered by the addition of Si and/or B to the values specified in claim 1.

Excellent wear resistance can be achieved even with diamond contents of 40% by volume. The upper limit of the diamond content of 90% by volume constitutes a barrier to cost-effective production. Moreover, in the case of higher diamond contents, a sufficient fracture toughness of the diamond composite material would no longer be ensured. Where a diamond, carbide and metal phase content has been varied, it is possible to produce customized wear parts for the most diverse possible requirements in terms of wear resistance, machining properties and costs.

Further structural constituents do not impair the properties to an inadmissible extent, as long as their content does not overshoot 5% by volume. Moreover, such structural constituents, such as, for example, small fractions of amorphous carbon, sometimes can be avoided completely only at relatively high outlay in production terms.

Particularly advantageous contents of carbidic phase and metallic/intermetallic alloy are around 0.1 to 10% by volume and around 10 to 30% by volume respectively.

Tests have shown that diamond powders can be processed in a broad gain-size range. In addition to natural diamonds, even synthetic diamonds which are more cost-effective can be processed. Good processing results have also been achieved with the commonly available coated diamond sorts. As a result, the sorts which are the most cost-effective in each case can be adopted. Particularly advantageous wear resistance can be achieved when diamond powder with a grain size of 20 to 200 μm is used.

By the use of diamond powder with a bimodally distributed grain size, with a first distribution maximum at 7 to 60 μm and with a second distribution maximum at 80 to 260 μm, it is possible to achieve high diamond packing densities and therefore high volume contents.

Wear parts are to be found in the most diverse possible fields of use. It has been possible to achieve initial excellent results in the case of water-jet nozzles, drill bit inserts, sawteeth and drill tips. The material according to the invention, because of its excellent thermal conductivity, especially when a metallic phase based on Cu, Al or Ag is used, is suitable particularly also for applications wherein the wearing stress is associated with the generation of heat. Brake discs for aircraft, rail vehicles, automobiles and motorcycles may be mentioned here, merely as examples.

With the above and other objects in view there is also provided, in accordance with the invention, a method of producing a wear part, such as the above-outlined part. The method comprises the following method steps:

shaping an intermediate material containing diamond grains having a mean grain size of 20 to 200 μm and, optionally, a metallic phase and/or a binder, a fraction of said diamond grains amounting to 40 to 90% in relation to an overall volume of the intermediate material after the shaping step;

heating the intermediate material and an infiltrate alloy based on Fe, Co, Ni, Cu, Ag, Zn, Pb, Sn or Al and at least one alloying element selected from the group consisting of Si, Ti, Zr, Hf, V, Nb, Ta, Cr, Mo, W, B, Sc, Y and lanthanides to a temperature above a liquidus temperature of the infiltrate alloy, but below 1450° C., causing an infiltration of the intermediate material by the infiltrate alloy and filling of pore spaces of the intermediate material to at least 97%.

In an alternative production process, the method comprises the following method steps:

mixing or milling an intermediate material containing diamond grains having a mean grain size of 20 to 200 μm and an infiltrate alloy based on Fe, Co, Ni, Cu, Ag, Zn, Pb, Sn or Al and at least one alloying element selected from the group consisting of Si, Ti, Zr, Hf, V, Nb, Ta, Cr, Mo, W, B, Sc, Y and lanthanides; and filling a die of a hot press with the intermediate material, heating to a temperature T, with 500° C.<T<1200° C., and hot pressing of the intermediate material;

to thereby form the wear part as outlined above.

The most diverse possible methods may be employed for production. Thus, it is possible for diamond powders coated with a carbide-forming element to be compressed with metal powder under temperature and pressure. This may take place, for example, in hot presses or hot-isostatic presses. Infiltration has been shown to be particularly advantageous. In this case, a precursor or intermediate material is produced, which may also contain a binder in addition to diamond powder. Particularly advantageous, in this case, are binders which pyrolyse up to a high fraction under the action of temperature. Advantageous binder contents are around 1 to 20% by weight. The diamond powder and binder are intermixed in conventional mixers or mills. Shaping takes place thereafter, which may be carried out by pouring into a mould or with the assistance of pressure, for example, by pressing or by metal-powder injection-moulding. Subsequently, the intermediate material is heated to a temperature at which the binder at least partially pyrolyses. However, the pyrolysis of the binder may also take place during heating in the infiltration process. The infiltration process may take place without pressure or with the assistance of pressure. The latter may be carried out in a sintering HIP plant or by means of squeeze casting. To select the composition, it is necessary to take into account the fact that the liquidus temperature of the respective infiltrate alloy (alloy which infiltrates into the porous body) is no higher than 1400° C., advantageously no higher than 1200° C., since the diamond fractions which decompose are otherwise too high. An infiltrate with a eutectic composition is particularly highly suitable for infiltration.

Other features which are considered as characteristic for the invention are set forth in the appended claims.

Although the invention is illustrated and described herein as embodied in wear part consisting of a diamond-containing composite material, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments as outlined in the production examples below.

EXAMPLE 1

Synthetic diamond powder with a mean grain size of 90 μm was pressed into a plate having the dimension 35 mm×35 mm×5 mm at a pressure of 200 MPa by means of matrix pressing. The pore fraction of the plate was approximately 20% by volume.

Subsequently, this plate was covered with a piece of the infiltrate alloy which had already been melted in a preceding process and the liquidus and solidus temperature of which were determined by means of thermal analysis. The compositions of the infiltrate alloys are reproduced in Table 1. The porous diamond body and the infiltrate alloy were first heated under a vacuum to a temperature of 70° C. above the liquidus temperature of the respective infiltrate alloy in a sintering HIP plant. After a holding time of 10 minutes, an argon gas pressure of 40 bar was set. After a further holding time of 5 minutes, the sample was cooled to room temperature by the heating being switched off and with flooding with argon gas and was subjected to further heat treatment for one hour at 200° C. at the respective non-variance temperature. The formation of a carbidic phase encasing the diamond grains occurred in all the variants investigated.

The diamond composite materials according to the invention were subjected to a sandblasting test and compared with hard metal having a Co content of 2% by weight. The erosion rates in relation to the reference hard metal are reproduced in the following Table 1.

TABLE 1

| | Composition of the infiltrate alloy (in % by weight) | Relative erosion rate |
|---|---|---|
| Materials according to the invention | Cu 10%Ni 10%Si | 0.5 |
| | Cu 2%Zr 10%Si | 0.6 |
| | Cu 3%Cr 10%Si | 0.6 |
| | Al 3.5%Cu 7%Si | 0.7 |
| | Al 30%Si | 0.7 |
| | Al 5%Ti 7%Si | 0.75 |
| | Ni 29%Si | 0.6 |
| | Ni 15%Cr 7%Fe 2.5%Ti 20%Si | 0.35 |
| | Zn 4%Cr | 0.65 |
| | Fe 20%Cr 20%Si | 0.45 |
| Comparative | WC 2%Co | 1 |

We claim:

1. A wear part, comprising:

a diamond-containing composite material with:

40 to 90% by volume diamond grains having a mean diamond-grain size of 20 to 200 μm;

0.001 to 12% by volume carbidic phase formed from one or more elements selected from the group consisting of Si, Y, and La; and 7 to 49% by volume of a metallic or intermetallic alloy with a liquidus temperature<1400° C.;

said metallic or intermetallic alloy containing said element or elements forming said carbidic phase in dissolved or precipitated form and having a hardness at room temperature>250 HV.

2. The wear part according to claim 1, wherein said diamond grains have a surface encased at least 60% by said carbidic phase.

3. The wear part according to claim 1, wherein said metallic or intermetallic alloy has a solidus temperature<1200° C.

4. The wear part according to claim 1, wherein a volume ratio of said metallic or intermetallic alloy to said carbidic phase is greater than 4.

5. The wear part according to claim 1, wherein said carbidic phase is formed by Si.

6. The wear part according to claim 1, wherein said carbidic phase is formed at least partially by reaction with carbon of said diamond.

7. The wear part according to claim 1, wherein said metallic alloy is a hypereutectic Al—Si alloy.

8. The wear part according to claim 1, wherein said metallic alloy is a heat-treatable Cu—Si—Zr alloy, Cu—Si—Cr alloy, or Cu—Si—Zr—Cr alloy.

9. The wear part according to claim 1, wherein said metallic or intermetallic alloy has a hardness>400 HV.

10. The wear part according to claim 1, wherein said metallic or intermetallic alloy has a liquidus temperature<1200° C.

11. The wear part according to claim 1, wherein a fraction of further phases is lower than 5% by volume.

12. The wear part according to claim 1, wherein a diamond-grain size is distributed bimodally, with a first distribution maximum at 7 to 60 μm and a second distribution maximum at 80 to 260 μm.

13. The wear part according to claim 1, wherein said composite material contains 60 to 80% by volume of diamond grains, 1 to 10% by volume of said carbidic phase, and 10 to 30% by volume of said metallic alloy.

14. The wear part according to claim 1 configured as a nozzle or mixing tube for abrasive water-jet cutting plants.

15. The wear part according to claim 1 configured as a drill bit insert or drill tip for drilling tools.

16. The wear part according to claim 1 configured as a brake disc.

17. The wear part according to claim 1 configured as a grinding wheel.

18. The wear part according to claim 1 configured as a sawtooth.

19. A method for producing the wear part according to claim 1, the method which comprises the following method steps:

shaping an intermediate material containing diamond grains having a mean grain size of 20 to 200 μm and, optionally, a metallic phase and/or a binder, a fraction of said diamond grains amounting to 40 to 90% in relation to an overall volume of the intermediate material after the shaping step;

heating the intermediate material and an infiltrate alloy based on Fe, Co, Ni, Cu, Ag, Zn, Pb, Sn or Al and at least one alloying element selected from the group consisting of Si, B, Y, and La to a temperature above a liquidus temperature of the infiltrate alloy, but below 1450° C., causing an infiltration of the intermediate material by the infiltrate alloy and filling of pore spaces of the intermediate material to at least 97%.

20. The method according to claim 19, which comprises selectively carrying out the shaping step by pressureless or pressure-assisted shaping, and carrying out the heating step by pressureless or pressure-assisted heating.

21. The method according to claim 19, wherein the infiltrate alloy has a eutectic or near-eutectic composition.

22. A method for producing the wear part according to claim 1, the method which comprises the following method steps:

mixing or milling an intermediate material containing diamond grains having a mean grain size of 20 to 200 μm and an infiltrate alloy based on Fe, Co, Ni, Cu, Ag, Zn, Pb, Sn or Al and at least one alloying element selected from the group consisting of Si, B, Y, and La;

filling a die of a hot press with the intermediate material, heating to a temperature T, with 500° C.<T<1200° C., and hot pressing of the intermediate material.

23. The method according to claim 22, wherein the infiltrate alloy has a eutectic or near-eutectic composition.

24. A wear part, comprising:

a diamond-containing composite material with:

40 to 90% by volume diamond grains;

0.001 to 12% by volume carbidic phase formed from one or more elements selected from the group consisting of Si, Y, and La; and 7 to 49% by volume of a metallic or intermetallic alloy with a liquidus temperature<1400° C.;

said metallic or intermetallic alloy containing said element or elements forming said carbidic phase in dissolved or precipitated form and having a hardness at room temperature>250 HV; and wherein said metallic alloy is a heat-treatable Cu—Si—Zr alloy, Cu—Si—Cr alloy, or Cu—Si—Zr—Cr alloy.

* * * * *